US009996992B2

(12) United States Patent
Albitz et al.

(10) Patent No.: US 9,996,992 B2
(45) Date of Patent: Jun. 12, 2018

(54) VEHICULAR EVENT MONITORING SYSTEM

(71) Applicant: R. Albitz, LLC, Lake Orion, MI (US)

(72) Inventors: Robert Thomas Albitz, Lake Orion, MI (US); Stayko Dimitrov Staykov, Nashville, TN (US)

(73) Assignee: R. Albitz, LLC, Lake Orion, MI (US)

( * ) Notice: Subject to any disclaimer, the term of this patent is extended or adjusted under 35 U.S.C. 154(b) by 184 days.

(21) Appl. No.: 15/015,644

(22) Filed: Feb. 4, 2016

(65) Prior Publication Data

US 2017/0228948 A1 Aug. 10, 2017

(51) Int. Cl.
*G07C 5/08* (2006.01)
*G07C 5/00* (2006.01)

(52) U.S. Cl.
CPC ..... *G07C 5/0841* (2013.01); *G07C 5/008* (2013.01)

(58) Field of Classification Search
CPC combination set(s) only.
See application file for complete search history.

(56) References Cited

U.S. PATENT DOCUMENTS 9,218,698 B2 * 12/2015 Ricci ..... H04W 4/21
9,773,281 B1 * 9/2017 Hanson ..... G06Q 40/08
2013/0304278 A1 * 11/2013 Chen ..... G06F 17/00 701/2
2015/0187146 A1 * 7/2015 Chen ..... G07C 5/008 701/31.5
2015/0365807 A1 * 12/2015 Gianakis ..... H04W 4/90 455/404.1
2016/0232721 A1 * 8/2016 Singh ..... G07C 5/008
2016/0323741 A1 * 11/2016 Lee ..... H04W 12/06

* cited by examiner

*Primary Examiner* — Thomas G Black
*Assistant Examiner* — Ana D Thomas
(74) *Attorney, Agent, or Firm* — Nelson Mullins Riley & Scarborough LLP; Anthony A. Laurentano

(57) ABSTRACT

A method and system for gathering, storing, and retrieving information from vehicular information sources in the vicinity of an event involving a vehicle is provided. Information is captured using sensors associated with a vehicle. The sensors may monitor systems within the vehicle and the external surroundings of the vehicle. Information is recorded for a selected period of time and then tagged. The tagged information is transmitted and received using one or more radio frequency (RF) capable devices. The information is stored in a storage device and is automatically reviewed to determine if an event involving a vehicle occurred during a selected period of time. If an event has occurred, the stored information may be placed in an account accessible by a user. If the event is an accident, the stored information and newly gathered information may be automatically forwarded to a first responder in near real time.

14 Claims, 4 Drawing Sheets

VEHICULAR EVENT MONITORING SYSTEM

BACKGROUND

Technical Field

Example embodiments of the present application relate, in general, to the field of information and/or content management, and more particularly to the gathering, consolidation, and retrieval of information from one or more vehicle sensors associated with one or more vehicles in the vicinity of an event involving a vehicle.

Related Art

Many vehicles today are equipped with various driver support systems, for example, predictive safety systems and adaptive cruise control systems. Many vehicles are also equipped with sensors for monitoring the health of the vehicle, for example, temperature sensors, tire pressure monitors, fuel status monitors, accident monitors, and the like. In addition, many vehicles are equipped with sensors for providing the driver with information regarding the surrounding environment of the vehicle, for example, backup and side view monitoring cameras, proximity detectors, and the like. Vehicles may have an automated vehicle system status reporting capability, for example, the On Star® service. The aims with such systems are often to increase the driver's safety and comfort. Some of the systems may assist the driver with tasks that the driver would otherwise perform manually, for example, keeping the vehicle in a particular road lane, performing automated parking, and/or keeping a safe distance to a vehicle ahead.

In order to provide these semi-automatic or automatic vehicle functions, systems in the vehicle often autonomously monitor the surroundings of the vehicle using a number of sensors. The sensors may provide the vehicle system controllers with information on the status of the vehicle and the vehicle's surroundings, for example, the relative position of the vehicle, other vehicles in proximity to the vehicle, obstacles sensed or detected by the sensors, and/or road markings. As a result, the vehicle's semi-automatic or automatic systems may depend on reliable sensor information in order to function properly.

When a vehicle event occurs, for example, an accident, a system within the vehicle may transmit information indicating that the event has occurred. Due to limited memory, a system in the vehicle may be able to store system status information and sensor data only for a limited period of time.

SUMMARY OF THE INVENTION

An event involving a vehicle may captured by sensors in the vehicle. The event involving a first vehicle may captured by sensors in another vehicle or a plurality of vehicles in the vicinity of the first vehicle to which the event has occurred. Currently, the information captured by the other vehicle(s)'s sensors is not stored or maintained so as to assist in the resolution of the cause of the event for the first vehicle. Accordingly, systems and methods are employed to automatically capture, aggregate, store, and/or retrieve sensor information for a first vehicle involved in an event, and to automatically capture, aggregate, store, and retrieve sensor information from one or more additional vehicles which may be in the vicinity of the first vehicle when the event occurred.

The present application concerns methods and systems for providing the consolidation, storage, and retrieval of information from one or more sensors associated with one or more vehicles which may have captured an event involving a vehicle. With the present application, it may be possible to effectively capture, store, and retrieve information about an event, or near events, from a number of sensors located on a number of vehicles in the vicinity of the event. As a result of the present application, it may be possible to determine the cause of the event, or near event, which involves a first vehicle. In addition, vehicle information and/or surrounding information of the vehicle involved in the event, and ongoing information from the scene of the event, as sensed by vehicle's sensors, may be sent automatically and/or upon request to first responders in a near real time manner.

In an exemplary embodiment, the present application is related to a method for retrieving information associated with an event involving a vehicle. Information is captured using one or more of sensors located on the vehicle. The one or more sensors may monitor systems within the vehicle and the external surroundings of the vehicle. The vehicle information and surrounding information may be recorded for a selected period of time. The recorded information, from the internal vehicle systems and the external surroundings may be tagged. The information may be tagged with, for example, a time stamp indicating when the information was recorded. Those of ordinary skill in the art will readily recognize information may be tagged in other ways and with other types of information. The information may be tagged, for example, with an identifier for the vehicle, with the geolocation information of the vehicle, and/or with an identifier for the road.

The tagged information for the vehicle information and the surrounding information may be then transmitted using a radio frequency (RF) capable device. The transmitted information may be received by another RF capable device. The received vehicle information and the surrounding information may be stored in a storage device and/or in a database. The information may be automatically reviewed to determine if a vehicle event occurred during the selected period of time for which the information was recorded. If an event involving a vehicle has occurred during the selected period of time, the stored vehicle information and the stored surrounding information may be retrieved from the storage device and may be placed in a user account accessible to a user.

In one embodiment of the method, the event may comprise an accident involving the vehicle, an injury, a medical emergency to a person or animal riding inside the vehicle, and/or a reckless driving incident by another driver in the vicinity of the vehicle. The reckless driving incident may comprise another vehicle speeding past the first vehicle, another vehicle approaching the first vehicle below a distance threshold and/or at above a speed threshold, for example, cutting off the first vehicle, or another vehicle operating in an unsafe manner, for example, the other vehicle carrying an unsafe load.

In one embodiment of the method, the vehicle information recorded during the selected period of time may include information pertaining to the speed of the vehicle. The vehicle information may also include information on whether the vehicle is involved in an accident. The vehicle information may also include information on an operational status of a system within vehicle, for example, information regarding the braking system, the tire pressure system, the coolant system, and/or the traction control system for the vehicle. The vehicle information may also include information regarding objects in proximity to the vehicle obtained from proximity sensors located on the vehicle.

In one embodiment of the method, the surrounding information observed from sensors on the vehicle may comprise video information, audio information, and/or measured environmental information. The video information may include video from one or more video devices located on the vehicle. The measured environmental information may include information on the temperature, both inside and outside of the vehicle, the humidity, both inside and outside of the vehicle, geolocation information for the coordinates of the vehicle, and/or outside lighting conditions.

In one embodiment of the method, the stored vehicle information and the stored surrounding information may be from one or more vehicles within a vicinity of the event during the selected period of time in which the event occurred. The stored vehicle information and the stored surrounding information may then be retrieved and supplied to a user. The user may then correlate and/or aggregate the tagged information, for example, by determining information with a similar tag, for example, a similar time stamp, from the one or more vehicles within the vicinity of the first vehicle to which the event occurred, so as to better determine the cause of the event, or near event, and to better determine who might be responsible for the event, or near event.

In one embodiment of the method, if a vehicle event occurs and if the vehicle event is an accident involving the vehicle, the stored vehicle information and the surrounding information may be tagged with an emergency tag indicator. The vehicle information and/or surrounding information with the emergency tag may be provided automatically and/or upon request to a first responder in the vicinity of the event and/or the location of the vehicle. The vehicle information and/or surrounding information with the emergency tag may be automatically provided to a first responder who is in the vicinity of the location of the event and/or the location of the vehicle. Vehicle information and/or the surrounding information from the next one or more selected periods of time may be provided to the first responder on a continuous basis. This may allow the first responder to have near real time information updates associated with the event.

In one embodiment of the method, if an event has not occurred during the selected period of time in which data was recorded, the stored vehicle information and surrounding information may be deleted after a selected period of time to free up memory space in the storage device.

In another exemplary embodiment, the present application is related to a system for capturing information associated with an event involving a vehicle. Information from sensors associated with the vehicle may be captured by a vehicle data recorder for a selected period of time. An environment recording device may also capture information about the surroundings of the vehicle for the selected period of time. The recorded vehicle information and the recorded surrounding information may be tagged by a processing device with, for example, a time stamp indicating when the information was recorded. Those of ordinary skill in the art will readily recognize information may be tagged in other ways and with other types of information. The information may be tagged, for example, with an identifier for the vehicle, with the geolocation information of the vehicle, and/or with an identifier for the road. The tagged information for the vehicle information and the surrounding information may be transmitted using a radio frequency (RF) capable device.

In one embodiment of the system, the event may comprise an accident involving the vehicle, an injury, a medical emergency to a person or animal riding inside the vehicle, and/or a reckless driving incident by another driver in the vicinity of the vehicle. The reckless driving incident may comprise another vehicle speeding past the first vehicle, another vehicle approaching the first vehicle below a distance threshold and/or at above a speed threshold, for example, cutting off the first vehicle, or another vehicle operating in an unsafe manner, for example, the other vehicle carrying an unsafe load.

In one embodiment of the system, the vehicle information recorded during the selected period of time may include information pertaining to the speed of the vehicle. The vehicle information may also include information on whether the vehicle is involved in an accident. The vehicle information may also include information on the operational status of a system within vehicle, for example, information regarding the braking system, the tire pressure system, the coolant system, and/or the traction control system for the vehicle. The vehicle information may also include information regarding objects in proximity to the vehicle obtained from proximity sensors located on the vehicle.

In one embodiment of the system, the surrounding information observed from sensors on the vehicle may comprise video information, audio information, and/or measured environmental information. The video information may include video from one or more video devices located on the vehicle. The measured environmental information may include information on the temperature, both inside and outside of the vehicle, the humidity, both inside and outside of the vehicle, geolocation information for the coordinates of the vehicle, and/or outside lighting conditions.

In one embodiment of the system, if an event occurs and if the event is an accident involving the vehicle, a processing device in the system may place an emergency tag indicator on the vehicle information and the surrounding information. The vehicle information and/or surrounding information with the emergency tag indicator may be transmitted by an RF capable device in the system and/or an RF capable device connected to the system.

In another exemplary embodiment, the present application is related to a system for retrieving event related information involving a vehicle. The system may include a data recorder in the vehicle which records vehicle system information from one or more sensors for a selected period of time. An environment recording device may also capture information about the surroundings of the vehicle from one or more sensors for the selected period of time. The recorded vehicle information and the recorded surrounding information may be tagged by a first processing device with, for example, a time stamp indicating when the information was recorded. Those of ordinary skill in the art will readily recognize information may be tagged in other ways and with other types of information. The information may be tagged, for example, with an identifier for the vehicle, with the geolocation information of the vehicle, and/or with an identifier for the road. The tagged information for the vehicle information and the surrounding information is then transmitted using a first radio frequency (RF) capable device.

The transmitted data may be received by a second RF capable device. The received tagged vehicle information and the surrounding information may be stored in a storage device and/or in a database which is accessible to a user via the Internet and/or by a user interface. The received information may be automatically reviewed by a second processing device to determine if an event has occurred during the selected period of time for which the information was recorded. If an event has occurred during the selected period of time, the stored vehicle information and the stored surrounding information may be retrieved by the second processing device from the storage device and may be placed in a user account accessible to a user.

In one embodiment of the system, the event may comprise an accident involving the vehicle, an injury, a medical emergency to a person or animal riding inside the vehicle, and/or a reckless driving incident by another driver in the vicinity of the vehicle. The reckless driving incident may comprise another vehicle speeding past the first vehicle, another vehicle approaching the first vehicle below a distance threshold and/or at above a speed threshold, for example, cutting off the first vehicle, or another vehicle operating in an unsafe manner, for example, the other vehicle carrying an unsafe load.

In one embodiment of the system, the vehicle information recorded during the selected period of time may include information pertaining to the speed of the vehicle. The vehicle information may also include information on whether the vehicle is involved in an accident. The vehicle information may also include information on the operational status of a system within vehicle, for example, information regarding the braking system, the tire pressure system, the coolant system, and/or the traction control system for the vehicle. The vehicle information may also include information regarding objects in proximity to the vehicle obtained from proximity sensors located on the vehicle.

In one embodiment of the system, the surrounding information observed from sensors on the vehicle may comprise video information, audio information, and/or measured environmental information. The video information may include video from one or more video devices located on the vehicle. The measured environmental information may include information on the temperature, both inside and outside of the vehicle, the humidity, both inside and outside of the vehicle, geolocation information for the coordinates of the vehicle, and/or outside lighting conditions as seen by sensors located in the vehicle.

In one embodiment of the system, the stored vehicle information and the stored surrounding information may be from one or more vehicles within a vicinity of the event during the selected period of time in which the event occurred. The stored vehicle information and the stored surrounding information may then be retrieved and supplied to a user. The user may then correlate and/or aggregate the tagged information, for example, by determining information with a similar tag, for example, a similar time stamp and/or a similar geolocation tag, from the one or more vehicles within the vicinity of the first vehicle to which the event occurred, so as to better determine the cause of the event, or near event, and to better determine who might be responsible for the event, or near event.

In one embodiment of the system, if an event occurs and if the event is an accident involving the vehicle, the received and stored vehicle information and the surrounding information may be tagged by the second processing device with an emergency tag indicator. The second processing device may provide the vehicle information and/or surrounding information with the emergency tag to a first responder in the vicinity of the event and/or the location of the vehicle. The vehicle information and/or surrounding information with the emergency tag may be provided to a first responder who in the vicinity of the event and/or the location of the vehicle. Vehicle information and/or the surrounding information from the next one or more record periods of time may be provided autonomously and/or upon request to the first responder on a continuous basis. This may allow the first responder to have near real time information updates associated with the event.

In one embodiment of the system, if an event has not occurred during the selected period of time in which data was recorded, the stored vehicle information and surrounding information may be deleted after a selected period of time to free up memory space in the storage device.

Although exemplary embodiments may be described herein with reference to particular software and hardware implementations, it is understood that the present application is not limited to the embodiments disclosed herein.

BRIEF DESCRIPTION OF THE DRAWINGS

The aforementioned features and advantages, and other features and aspects of the present application, will become better understood with regard to the following description and accompanying drawings.

DETAILED DESCRIPTION

Figure 1:
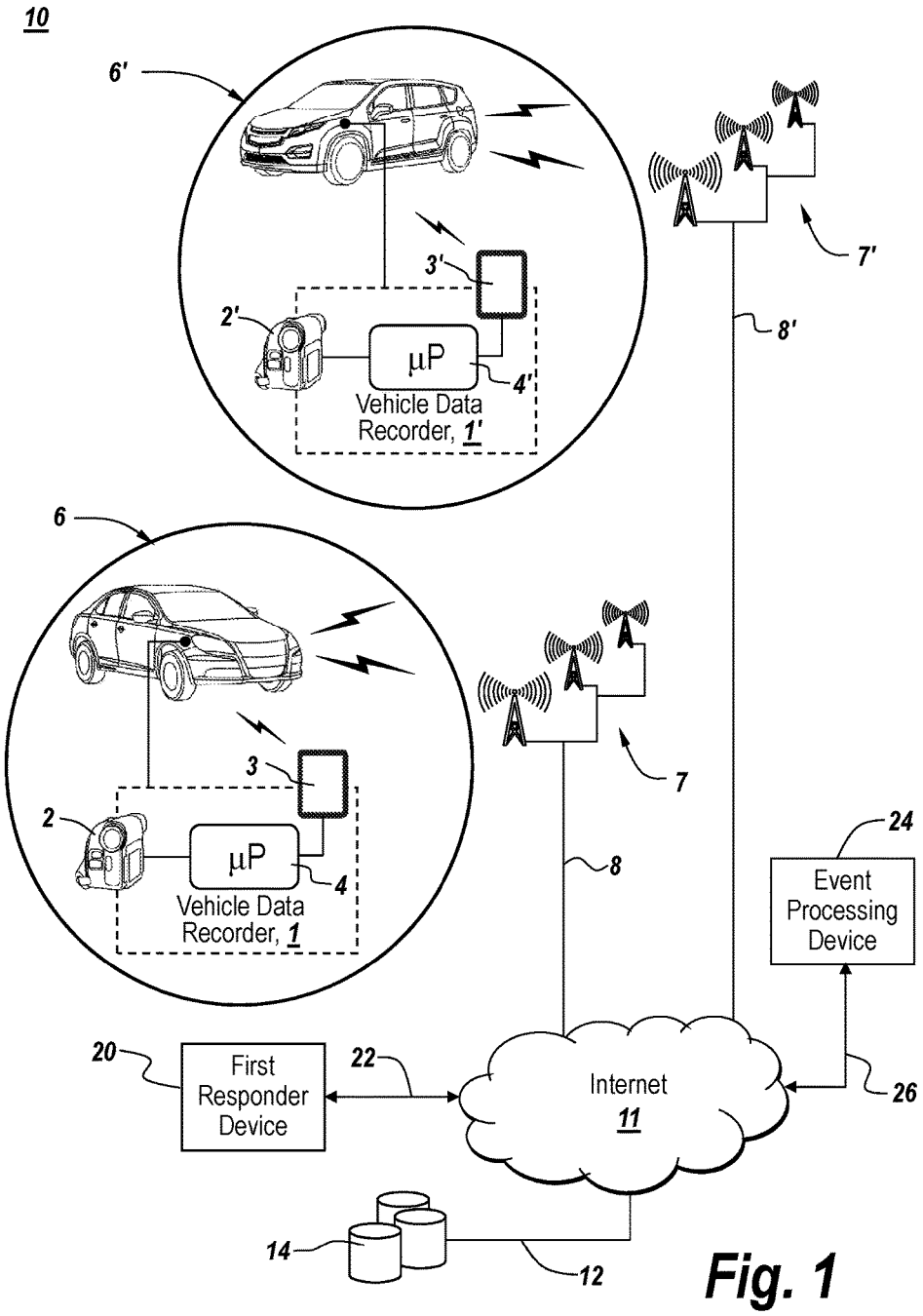
FIG. 1 is a schematic depiction of an example system implementation of the vehicular event monitoring system suitable for use with example embodiments of the present application.

Certain embodiments of the present application are described below. It is, however, expressly noted that the present application is not limited to these embodiments, but rather the intention is that additions and modifications to what is expressly described herein also are included within the scope of the present application. Specific structural and functional details disclosed herein are merely representative for purposes of describing example embodiments of the present application.

Moreover, it is to be understood that the features of the various embodiments of the present application are not mutually exclusive and can exist in various combinations and permutations, even if such combinations or permutations are not made express herein, without departing from the spirit and scope of the application. Example embodiments of the present application may be embodied in many alternate forms and should not be construed as limited to example embodiments of the present application set forth herein.

The terminology used herein is for the purpose of describing particular embodiments only and is not intended to be limiting of the present application. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this present application belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

A sensor may be any device capable of detecting or measuring a physical property, for example, a thermometer, a humidity monitor, a geolocation device capable of determining the coordinates of the vehicle's location, and/or a lighting sensor capable of determining the outside lighting condition. The sensor may also be any device capable of monitoring the surroundings of the vehicle, for example, a camera, an infrared sensing device, a Lidar device, a proximity detector, and/or a thermal detection device.

Exemplary embodiments of the present application relate to capturing, storing, and retrieving information which may be transferred over communication networks and/or computer networks, for example, telecommunication networks and the Internet. More particularly, the present application relates to capturing, storing, and retrieving tagged information from one or more vehicle sensors associated with one or more vehicles in the vicinity of an event involving a vehicle.

In addition, the information from the one or more sensors associated with one or more vehicles in the vicinity of an event may be made available to a user and/or a first responder. The information transferred may consist of electronic information and may comprise electronic audio media, video media, image media, textual content, and vehicle system information. The appropriate electronic information may be consolidated in a storage device and/or in a database according to one or more rules for defining an event and a vicinity, as defined by one or more persons, processes, electronic devices, electronic services, and/or based on a date, a time, or a unique identifier, and the like.

FIG. 1 depicts an example system 10 implementation of the vehicular event monitoring system suitable for use with example embodiments of the present application. The system 10 may include one or more vehicles 6, 6'. The one or more vehicles 6, 6' may be any type of vehicle which includes one or more sensors and/or one or more communication devices. For example, the vehicle may be a car, truck, motorcycle, bicycle, cart, train, airplane, boat, subway, and the like. The system may include a RF transmission network 7, 7', for example, a cellular communication system, and a communication network 11, for example, the internet. The RF transmission network 7, 7' may be connected to the communication network 11 using transmission lines and/or wireless connections 8, 8' capable of carrying information with a known protocol, for example, Ethernet.

The vehicles 6, 6' may contain one or more image acquisition devices or recording devices 2, 2' interfacing with a vehicle event recorder 1, 1'. The recording devices 2, 2' may comprise one or more sensors capable of gathering information, for example, internal vehicle sensors for gathering vehicle system status information and environment sensors, such as a camera, for gathering surrounding information external to the vehicle. The recording devices 2, 2' interface with one or more processors 4, 4' associated with the vehicle event recorder 1, 1'. The one or more processors 4, 4' interface with one or more RF capable devices 3, 3', for example, a cell phone or a vehicle transmitter/receiver device, for transmission and reception of information and commands, as supported by the vehicle event recorder 1, 1'.

Information received by the RF transmission network 7, 7' is sent to the communication network 11 via the transmission lines and/or wireless connections 8, 8'. The communication network 11 may provide the received information to a storage device 14 connected to the communication network 11 via a communication network to storage device interface 12. The communication network 11 may provide the received information to an event processing device 22 connected to the communication network 11 via a communication network to event processing device interface 22. The communication network 11 may automatically and/or upon request provide the received information to a first responder's electronic device 20, for example, a computer or communication device such as a cell phone, radio, walkie-talkie, and the like, interfacing to the communication network 11 via a communication network to first responder device interface 22, for example, an emergency broadcast system.

Figure 2:
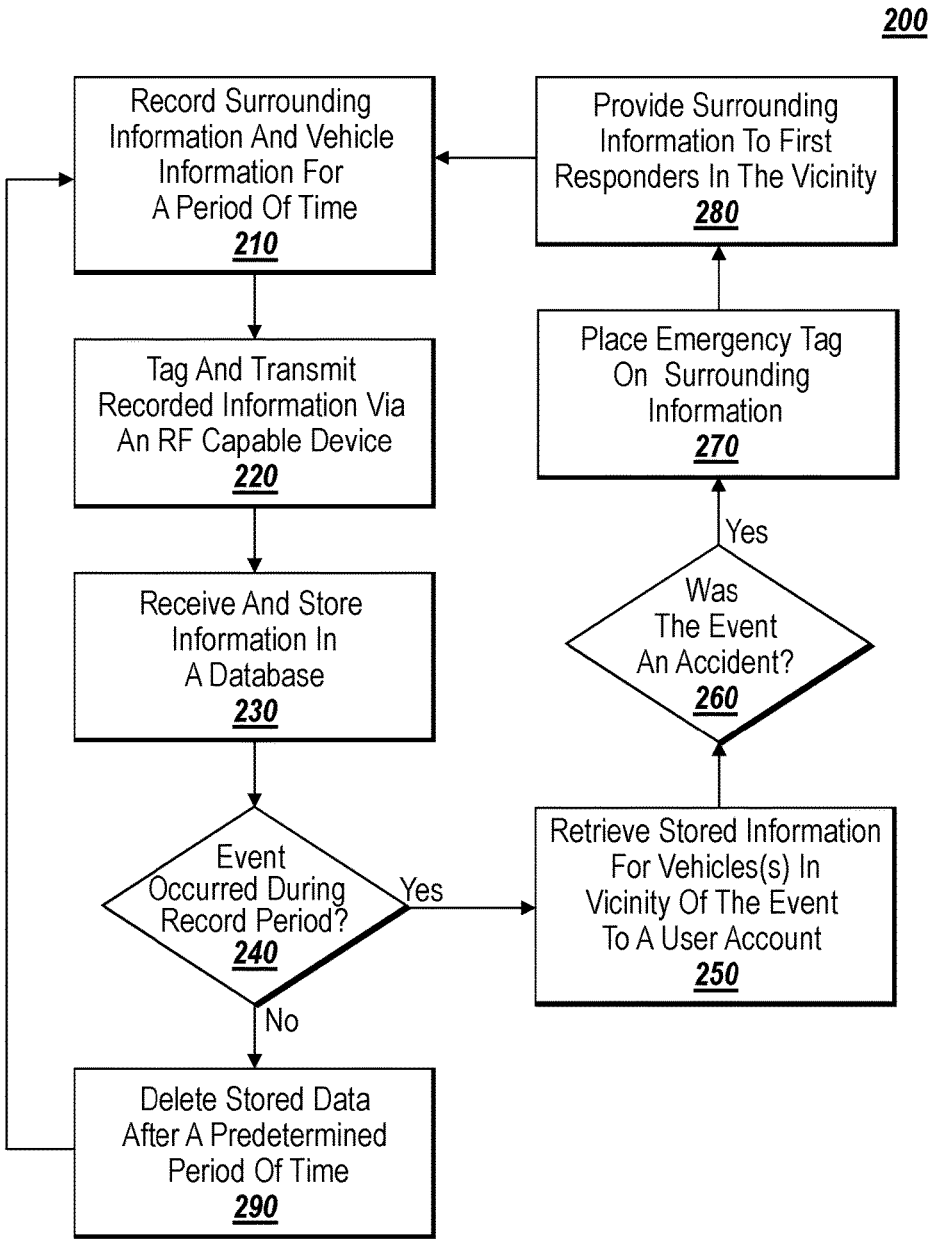
FIG. 2 depicts a flowchart diagram describing an exemplary method for capturing and retrieving event related information involving a vehicle with example embodiments of the present application.

FIG. 2 depicts a flowchart describing an exemplary method 200 for capturing and retrieving event related information involving a vehicle with example embodiments of the present application. At step 210, information from one or more sensors associated with one or more vehicles may be recorded. The information may comprise vehicle status information on, and/or measurements from, internal sensors within the vehicle, known in the present application as vehicle information.

The vehicle information may be measurements from a sensor detecting or measuring a physical property of the vehicle or a system within the vehicle, for example, a thermometer for the vehicle's cabin temperature, a thermometer for the temperature exterior to the vehicle, a thermometer for the vehicle's engine temperature, a humidity monitor the vehicle's cabin humidity, a humidity monitor for humidity exterior to the vehicle, a geolocation device capable of determining the coordinates of the vehicle's location, and/or a lighting sensor capable of determining the outside lighting condition.

The environment information may comprise information captured from sensors sensing or monitoring the environment external to the vehicle, known in the present application as surrounding information. The surrounding information may be measurements from a sensor detecting or measuring the surroundings of the vehicle, for example, the output of a camera, an infrared sensing device, a Lidar system, a proximity detector, and/or a thermal detection device.

The vehicle information and surrounding information may be recorded for a selected period of time. The recording duration period of time may be adjusted. The selected period of time may be defined by one or more persons, for example, the user of the vehicle, one or more processes, and/or one or more electronic services, for example, the cellular network. The selected period of time may also be defined based on a date, a time, and/or a unique identifier. For example, the selected period of time may be adjusted based on the capacity of the cellular network, the amount of vehicle traffic in an area, and the like.

At step 220, the vehicle information and the surrounding information may be tagged. The information may be tagged with, for example, a time stamp, indicating when the information was recorded. Those of ordinary skill in the art will readily recognize information may be tagged in other ways and with other types of information. The information may be tagged with, for example, an identifier for the vehicle, with the geolocation of the vehicle, and/or with an identifier for the road. The time for the time stamp may be determined by a processor located within the vehicle or the time for the time stamp may be received from an RF transmission, wherein the RF transmission includes the time information and/or time synchronization information. In the case where the time for the time stamp is received from an RF transmission, the time for the processor located in the vehicle data recorder may be synchronized with the time information received from the RF transmission. The tagged information for the vehicle information and the surrounding information may be transmitted using a radio frequency (RF) capable device. The tagged information for the vehicle information and the surrounding information may be stored locally in a memory residing in a subsystem contained within the vehicle. In the event there is a temporarily lack of RF access, the stored information may be transmitted at a later time when RF access permits. Thus, no tagged information is lost due to an issue with the communication link.

At step 230, the tagged information may be received by a second RF capable device. The second RF capable device may provide the received the tagged information to a storage device by using a communication network, for example, by using an internet connection. The received information may be stored in a storage device and/or in a database according to the tag associated with the received information.

At step 240, the stored information is automatically reviewed by an event processing device to determine if an event occurred during the record period of time. An event determination may be made on the information associated with the one or more sensor systems associated with the vehicle, for example, an accident detection sensor or a proximity detection sensor. The criteria for an event may be determined by one or more persons, one or more processes, and/or one or more electronic services. An event involving a vehicle, for example, may be an accident involving the vehicle, an injury, a medical emergency to a person or animal riding inside the vehicle, and/or a reckless driving incident by another driver in the vicinity of the vehicle. The reckless driving incident may comprise another vehicle speeding past the first vehicle, another vehicle approaching the first vehicle below a distance threshold and/or at above a speed threshold, for example, cutting off the first vehicle, or another vehicle operating in an unsafe manner, for example, the other vehicle carrying an unsafe load. The event may be a driver identified event through an interface to one or more vehicle system.

If an event occurred during the selected period of time, the stored information associated with one or more vehicles in the vicinity of the event of a first vehicle may be retrieved and provided to a user account, as indicated by step 250. The information may be provided from one or more vehicles with a similar tag. The similar tag may be, for example, a selected duration before the time stamp, during the record period of time, and/or a selected duration after the time stamp. The information may be retrieved and provided to the user account. The vicinity of the event of the first vehicle may be defined by a selected area around the first vehicle where the event occurred, by a geolocation identifier, and/or by a road identifier.

Whether the one or more vehicles are in the vicinity of the event may depend upon the capability of the one or more sensors associated with the one or more proximity vehicles to the event, for example, a vehicle with a higher resolution sensor may have a larger vicinity area than a vehicle with a lower resolution sensor. As a result, the one or more vehicles in the vicinity of the event may be determined by a radius of resolution of the one or more sensors on the proximity vehicle.

The user may then correlate and/or aggregate the tagged information, for example, by determining information with a similar tag, for example, a similar time stamp, from the one or more vehicles within the vicinity of the first vehicle to which the event occurred, so as to better determine the cause of the event, or near event, and to better determine who might be responsible for the event, or near event.

At step 260, the event processing device may determine if the event was an accident and/or an injury based on the received vehicle information and the surrounding information.

If the event was an accident and/or an injury, the event processing device may place an emergency tag indicator on the received vehicle information and/or the surrounding information, as indicated by step 270.

At step 280, the event processing device may provide the emergency tagged vehicle information and/or the surrounding information associated with the event automatically and/or upon request to first responders in the vicinity of the event and/or vehicle. If no first responders are in the vicinity of the event and/or the location of the vehicle, the event processing device may provide the emergency tagged vehicle information and/or the surrounding information to a first responder in the vicinity of the event and/or the location of the vehicle. The vehicle information and/or the surrounding information from the next one or more selected periods of time may be provided to the first responder on a continuous basis. This may allow the first responder to have near real time information updates associated with the event.

If, in step 240, the event processing device determines that no event has occurred during the selected period of time associated with the vehicle information and/or the surrounding information, the event processing device may indicate no event occurred with the stored data for that selected period of time.

At step 290, after a selected storage period of time, the event processing device may delete the stored information for selected period of time in which no event occurred, thus saving storage space in the storage device.

The vehicle information and the surrounding information for the next record period of time may be recorded and the steps of the method 200 for capturing and retrieving event related information involving a vehicle may be repeated.

Figure 3:
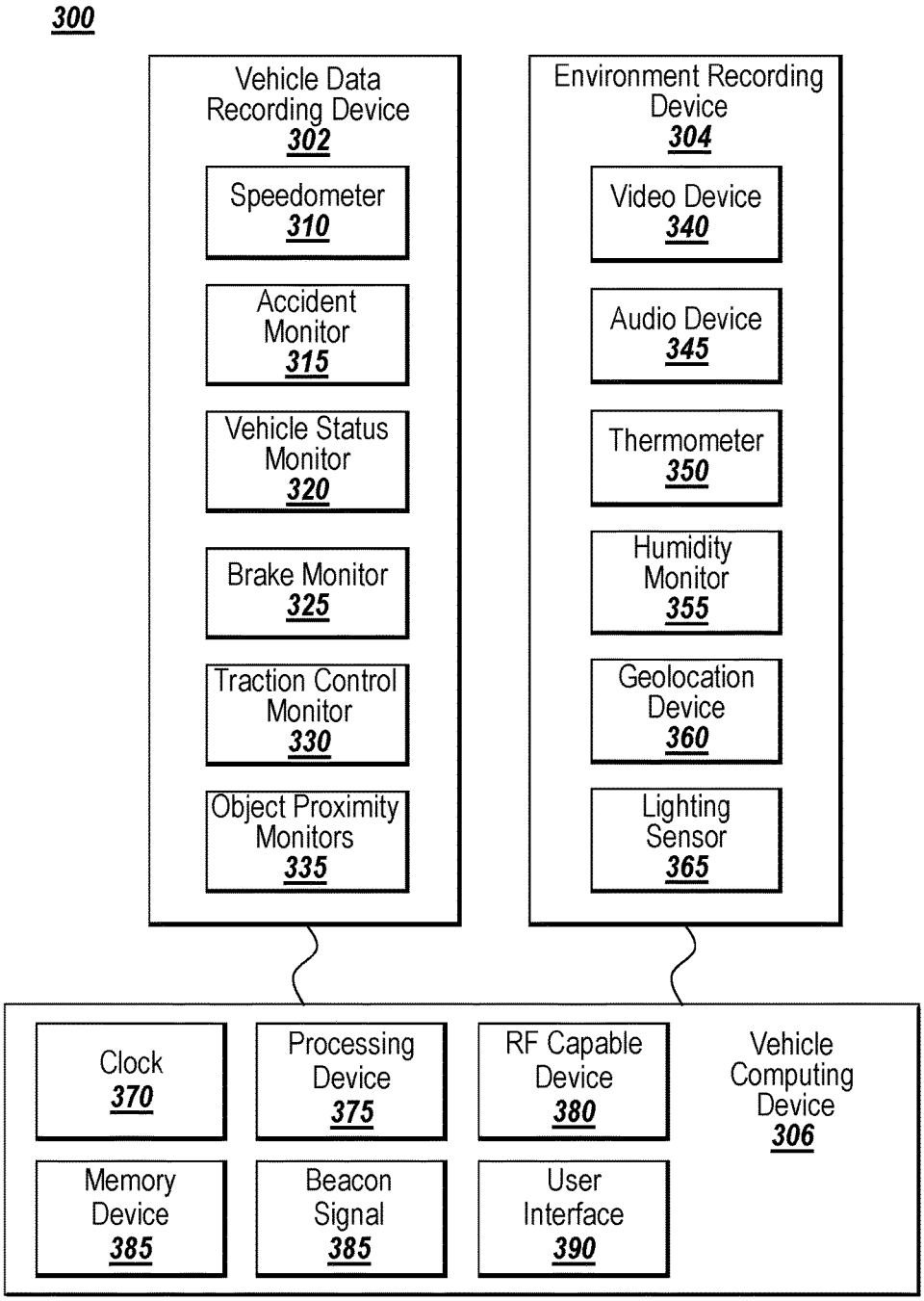
FIG. 3 is a block diagram schematic depiction of a vehicle system suitable for use with example embodiments of the present application.

FIG. 3 is a block diagram schematic depiction of a vehicle system 300 suitable for use with example embodiments of the present application. The vehicle system 300 may comprise a vehicle data recording device 302, an environment recording device 304, and/or a vehicle computing device 306.

The vehicle data recording device 302 may receive and record information based on one or more vehicle system sensors within the vehicle. For example, the vehicle data recording device 302 may receive and record information from a speedometer 310, an accident monitor 315, a vehicle status monitor 320, a brake monitor 325, a traction control monitor 330, and/or one or more object proximity monitors 335.

The environment recording device 304 may receive and record information based on one or more sensors capable of capturing the surroundings of the vehicle. The one or more sensors capable of capturing the surroundings of the vehicle may include a video device 340, for example, a camera and/or full motion video recorder. The video device 340 may capture the surroundings of the vehicle using a thermal sensor device, for example, an infrared sensing device, for example, Lidar or a thermal detection device such as an infrared camera. The video of the surroundings of the vehicle may be captured by one or more devices capable of recording only a portion of the surroundings as seen by the vehicle, or may be captured by one or more devices capable of recording all of the surroundings as seen by the vehicle, for example, an omni-directional sensor suite.

The environment recording device 304 may receive and record information audio information based on one or more audio devices 345, for example, a microphone.

The environment recording device 304 may receive and record information based on one or more sensors associated with the surrounding environment, internal to the vehicle, and/or external to the vehicle. For example, the one or more sensors associated with the surrounding environment may comprise a thermometer 350, a humidity monitor 355, a geolocation device capable of determining the coordinates of the vehicle's location 360, and/or a lighting sensor 365 capable of determining the outside lighting condition.

The vehicle computing device 306 may interface to, and receive vehicle information and the surrounding information from, the vehicle data recording device 302 and/or the environment recording device 304. The vehicle computing device 306 comprises a processing device 375. The processing device 375 may store information in a memory device 385. The processing device 375 may control the receiving and the transmitting of information using the RF capable device 380. The processing device 375 may receive a time associated with a time stamp for a record period of time from a clock 370. The processing device 375 may also receive a time associated with a time stamp from information received using the RF capable device 380. Upon receiving the vehicle information and the surrounding information associated with the record period of time, the processing device 375 may tag the information, for example, by using a time stamp derived from the time received from the clock 370 or the RF capable device 380.

The processing device 375 may control transmission and reception of a beacon signal 385. The beacon signal 385 may be used to correlate information between vehicles in the vicinity of the vehicle transmitting the beacon. For example, the beacon signal 385 may comprise information indicating a unique vehicle identifier, a synchronization time signal, and/or geolocation coordinates for the transmitting vehicle. The beacon signal 385 may be transmitted with a selected frequency. The beacon signal 385 may be transmitted as a function of the proximity of other vehicles. For example, the beacon signal 385 may be transmitted with a greater frequency as the proximity between the transmitting vehicle and another vehicle decreases or the beacon signal 385 may be transmitted with a lesser frequency as the proximity between the transmitting vehicle and another vehicle increases.

The processing device 375 may also receive information from, and report information to, a user through a user interface 390. The processing device 375 may receive from the user an indication of an event, for example, an accident, an injury, and/or a near event, such as a reckless driving incident. The user indicated event may comprise part of the surrounding information of the vehicle. The event reported by the user may pertain to the vehicle and its occupants and/or to another vehicle in the vicinity of the user.

One or more of the above described acts may be encoded as computer-executable instructions executable by processing logic. The computer-executable instructions may be stored on one or more non-transitory computer readable media. One or more of the above described acts may be performed in a suitably programmed electronic device, for example, a processor.

Figure 4:
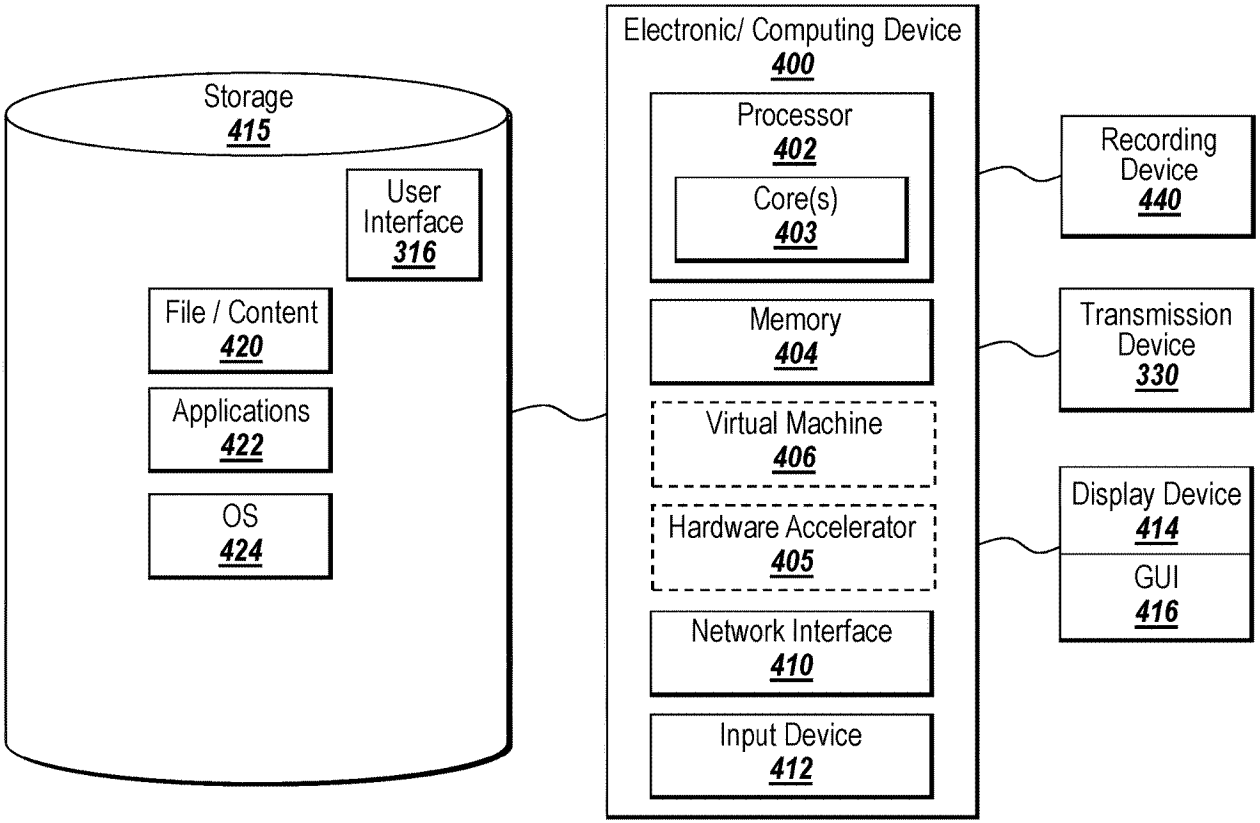
FIG. 4 is a schematic depiction of a computing device suitable for use with example embodiments of the present application.

FIG. 4 depicts an example of an electronic device, computing device, and/or processing device 400 suitable for use with one or more embodiments of the present application.

The electronic device 400 may take many forms, including but not limited to a computer, workstation, server, network computer, quantum computer, optical computer, Internet appliance, mobile device, a pager, a tablet computer, a smart sensor, application specific processing device, and the like.

The electronic device 400 is illustrative and may take other forms. For example, an alternative implementation of the electronic device 400 may have fewer components, more components, or components that are in a configuration that differs from the configuration of FIG. 4. The components of FIG. 4 and/or other figures of the present application may be implemented using hardware based logic, software based logic and/or logic that is a combination of hardware and software based logic (e.g., hybrid logic); therefore, the components illustrated in FIG. 4 and/or other figures are not limited to a specific type of logic.

The processor 402 may include hardware based logic or a combination of hardware based logic and software to execute instructions on behalf of the electronic device 400. The processor 402 may include logic that may interpret, execute, and/or otherwise process information contained in, for example, the memory 404. The processor 402 may be made up of one or more processing cores 403. The information may include computer-executable instructions and/or data that may implement one or more embodiments of the present application. The processor 402 may comprise a variety of homogeneous or heterogeneous hardware. The hardware may include, for example, some combination of one or more processors, microprocessors, field programmable gate arrays (FPGAs), application specific instruction set processors (ASIPs), application specific integrated circuits (ASICs), complex programmable logic devices (CPLDs), graphics processing units (GPUs), or other types of processing logic that may interpret, execute, manipulate, and/or otherwise process the information. Moreover, the processor 402 may include a system-on-chip (SoC) or system-in-package (SiP). One or more processors 402 may reside in the electronics device 400. An example of a processor 402 is the Intel® Core i3 series of processors available from Intel Corporation, Santa Clara, Calif.

The electronic device 400 may include one or more tangible non-transitory computer-readable storage media for storing one or more computer-executable instructions or software that may implement one or more embodiments of the present application. The non-transitory computer-readable storage media may be, for example, the memory 404 or the storage 415. The memory 404 may comprise a RAM that may include RAM devices that may store the information. The RAM devices may be volatile or non-volatile and may include, for example, one or more DRAM devices, flash memory devices, SRAM devices, zero-capacitor RAM (ZRAM) devices, twin transistor RAM (TTRAM) devices, read-only memory (ROM) devices, ferroelectric RAM (FeRAM) devices, magneto-resistive RAM (MRAM) devices, phase change memory RAM (PRAM) devices, or other types of RAM devices.

One or more computing devices 400 may include a virtual machine (VM) 406 for executing the instructions loaded in the memory 404. A virtual machine 406 may be provided to handle a process running on multiple processors so that the process may appear to be using only one computing resource rather than multiple computing resources. Virtualization may be employed in the electronic device 400 so that infrastructure and resources in the electronic device may be shared dynamically. Multiple VMs 406 may be resident on a single computing device 400.

A hardware accelerator 405 may be implemented in an ASIC, FPGA, or some other device. The hardware accelerator 405 may be used to reduce the general processing time of the electronic device 400.

The electronic device 400 may include a network interface 410 to interface to a Local Area Network (LAN), Wide Area Network (WAN) or the Internet through a variety of connections including, but not limited to, standard telephone lines, LAN or WAN links (e.g., T1, T3, 56 kb, X.25), broadband connections (e.g., integrated services digital network (ISDN), Frame Relay, asynchronous transfer mode (ATM), wireless connections (e.g., 502.11), RF connections, high-speed interconnects (e.g., InfiniBand, gigabit Ethernet, Myrinet) or some combination of any or all of the above. The network interface 410 may include a built-in network adapter, network interface card, personal computer memory card international association (PCMCIA) network card, card bus network adapter, wireless network adapter, universal serial bus (USB) network adapter, modem or any other device suitable for interfacing the electronic device 400 to any type of network capable of communication and performing the operations of the present application.

The electronic device 400 may include one or more user input devices 412, for example, a keyboard, a multi-point touch interface, a pointing device (e.g., a mouse), a gyroscope, an accelerometer, a haptic device, a tactile device, a neural device, a microphone, or a camera that may be used to receive input from, for example, a user. Note that electronic device 400 may include other suitable I/O peripherals.

The input devices 412 may allow a user to provide input that is registered on a visual display device 414. A graphical user interface (GUI) 416 may be shown on the display device 414.

A storage device 415 may also be associated with the computer 400. The storage device 415 may be accessible to the processor 402 via an I/O bus. The information in the storage device 415 may be executed, interpreted, manipulated, and/or otherwise processed by the processor 402. The storage device 415 may include, for example, a storage device, such as a magnetic disk, optical disk (e.g., CD-ROM, DVD player), random-access memory (RAM) disk, tape unit, and/or flash drive. The information may be stored on one or more non-transient tangible computer-readable media contained in the storage device. This media may include, for example, magnetic discs, optical discs, magnetic tape, and/or memory devices (e.g., flash memory devices, static RAM (SRAM) devices, dynamic RAM (DRAM) devices, or other memory devices). The information may include data and/or computer-executable instructions that may implement one or more embodiments of the present application.

The storage device 415 may store any modules, outputs, displays, files, content, and/or information 420 provided in example embodiments. The storage device 415 may store applications 422 for use by the computing device 400 or another electronic device. The applications 422 may include programs, modules, or software components that allow the electronic device 400 to perform tasks. Examples of applications include monitor logs, tagged rule creation, hierarchical tree routing, word processing software, shells, Internet browsers, productivity suites, and programming software. The storage device 415 may store additional applications for providing additional functionality, as well as data for use by the computing device 400 or another device. The data may include files, variables, parameters, images, text, and other forms of data.

The storage device 415 may further store an operating system (OS) 423 for running the computing device 400. Examples of OS 423 may include the Microsoft® Windows® operating systems, the Unix and Linux operating systems, the MacOS® for Macintosh computers, an embedded operating system, such as the Symbian OS, a real-time operating system, an open source operating system, a proprietary operating system, operating systems for mobile electronic devices, or other operating system capable of running on the electronic device and performing the operations of the present application. The operating system may be running in native mode or emulated mode.

A transmission device 430 may also be associated with the computer 400. The transmission device 430 may be capable of transmitting and receiving information over radio frequencies using common protocols.

A recording device 440 may also be associated with the computer 400. The recording device may record information received from the one or more sensors associated with the one or more vehicle systems. The recording device may record information received from one or more sensors located on the vehicle to monitor the surroundings of the vehicle.

One or more embodiments of the present application may be implemented using computer-executable instructions and/or data that may be embodied on one or more non-transitory tangible computer-readable mediums. The mediums may be, but are not limited to, a hard disk, a compact disc, a digital versatile disc, a flash memory card, a Programmable Read Only Memory (PROM), a Random Access Memory (RAM), a Read Only Memory (ROM), Magnetoresistive Random Access Memory (MRAM), a magnetic tape, or other computer-readable media.

One or more embodiments of the present application may be implemented in a programming language. Some examples of languages that may be used include, but are not limited to, Python, C, C++, C#, Java, JavaScript, a hardware description language (HDL), unified modeling language (UML), and Programmable Logic Controller (PLC) languages. Further, one or more embodiments of the present application may be implemented in a hardware description language or other language that may allow prescribing computation. One or more embodiments of the present application may be stored on or in one or more mediums as object code. Instructions that may implement one or more embodiments of the present application may be executed by one or more processors. Portions of the present application may be in instructions that execute on one or more hardware components other than a processor.

It is understood that the present application may be implemented in a distributed or networked environment. For example, information may be provided and manipulated at a central server, while a user interacts with the information through a user terminal.

The foregoing description may provide illustration and description of various embodiments of the present application, but is not intended to be exhaustive or to limit the present application to the precise form disclosed. Modifications and variations may be possible in light of the above teachings or may be acquired from practice of the present application. For example, while a series of acts has been described above, the order of the acts may be modified in other implementations consistent with the principles of the present application. Further, non-dependent acts may be performed in parallel.

In addition, one or more implementations consistent with principles of the present application may be implemented using one or more devices and/or configurations other than those illustrated in the Figures and described in the Specification without departing from the spirit of the present application. One or more devices and/or components may be added and/or removed from the implementations of the figures depending on specific deployments and/or applications. Also, one or more disclosed implementations may not be limited to a specific combination of hardware.

Furthermore, certain portions of the present application may be implemented as logic that may perform one or more functions. This logic may include hardware, such as hardwired logic, an application-specific integrated circuit, a field programmable gate array, a microprocessor, software, or a combination of hardware and software.

It is intended that the present application not be limited to the particular embodiments disclosed above, but that the present application will include any and all particular embodiments and equivalents falling within the scope of the following appended claims.

What is claimed is:

1. A method for retrieving information associated with an event involving a vehicle, the method comprising:

recording vehicle information and surrounding information of a first vehicle for a selected period of time;

tagging the vehicle information and the surrounding information with a tag;

storing the vehicle information and the surrounding information of the first vehicle in a storage device;

determining if the event occurred during the selected period of time; and if the event occurred, retrieving the stored vehicle information or the stored surrounding information from the storage device of the first vehicle and retrieving stored vehicle information from one or more other vehicles within a vicinity of the event during the selected period of time.

2. The method of claim 1, wherein the event comprises at least one of an accident, an injury, and a reckless driving incident.

3. The method of claim 1, wherein the vehicle information comprises at least one of vehicle speed information, accident status monitor information, vehicle operational status information, vehicle braking status information, vehicle traction control status information, vehicle tire status information, and object proximity status information.

4. The method of claim 1, wherein the surrounding information comprises at least one of video information, audio information, and measured environmental information.

5. The method of claim 4, wherein the video information comprises video from one or more video devices located on the vehicle.

6. The method of claim 4, wherein the measured environmental information comprises at least one of a temperature, a humidity, geolocation information for the vehicle, and a lighting condition.

7. The method of claim 1, wherein the stored vehicle information of the one or more other vehicles includes retrieving stored vehicle information or stored surrounding information from the storage.

8. The method of claim 1, wherein if the event occurred and the event is an accident involving the vehicle, placing an emergency tag on the stored surrounding information, and providing the emergency tagged surrounding information to a first responder in a vicinity of the event.

9. The method of claim 1, wherein, if the event has not occurred, the method further comprises deleting the stored vehicle information and the stored surrounding information from the storage device after a selected storage period of time.

10. A system for retrieving information associated with an event involving a vehicle, the system comprising:

a vehicle data recorder which records vehicle information of a first vehicle for a selected period of time;

an environment recording device which records surrounding information of the first vehicle for the selected period of time;

a processing device which tags the vehicle information and the surrounding information of the first vehicle with a tag;

a first radio frequency (RF) capable device which transmits or receives the vehicle information and the surrounding information of the first vehicle;

a storage device which stores the received vehicle information and the surrounding information; and wherein the processing device determines if an event has occurred during the selected period of time based on the stored vehicle information and the surrounding information, wherein, if the event occurred, the processing device places the stored vehicle information and the surrounding information in a user account and retrieves vehicle information from one or more other vehicles within a vicinity of the event during the selected period of time.

11. The system of claim 10, wherein the event comprises at least one of an accident, an injury, and a reckless driving incident.

12. The system of claim 10, wherein the vehicle information comprises at least one of vehicle speed information, vehicle operational status information, vehicle braking status information, vehicle traction control status information, vehicle tire status information, and object proximity status information, and wherein the surrounding information comprises at least one of video information, audio information, and measured environmental information.

13. The system of claim 10, wherein the retrieving of the vehicle information comprises retrieving stored vehicle information and stored surrounding information from the one or more other vehicles within the vicinity of the event during the selected period of time.

14. The system of claim 10, wherein if the event is an accident involving the vehicle the processing device places an emergency tag on the stored surrounding information and provides the emergency tagged surrounding information to a first responder in a vicinity of the event.

* * * * *